US010667660B2

(12) United States Patent
McIntosh et al.

(10) Patent No.: US 10,667,660 B2
(45) Date of Patent: Jun. 2, 2020

(54) SUCTION NOZZLE

(71) Applicant: Dyson Technology Limited, Wiltshire (GB)

(72) Inventors: Donald James McIntosh, Gloucester (GB); James Robert Carswell, Bristol (GB); Luke William Stephens, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 240 days.

(21) Appl. No.: 15/982,466

(22) Filed: May 17, 2018

(65) Prior Publication Data

US 2018/0333027 A1 Nov. 22, 2018

(30) Foreign Application Priority Data

May 18, 2017 (GB) ..... 1707991.4

(51) Int. Cl.

| | |
|---|---|
| ***A47L 9/00*** | (2006.01) |
| ***A47L 9/02*** | (2006.01) |
| ***A47L 5/22*** | (2006.01) |
| ***A47L 9/24*** | (2006.01) |

(52) U.S. Cl.

CPC ..... *A47L 9/0072* (2013.01); *A47L 5/225* (2013.01); *A47L 9/02* (2013.01); *A47L 9/244* (2013.01)

(58) Field of Classification Search

CPC ..... A47L 9/0072; A47L 5/225; A47L 9/02; A47L 9/244; A47L 9/04

USPC ..... 15/375, 419

See application file for complete search history.

(56) References Cited

U.S. PATENT DOCUMENTS

| | | | |
|---|---|---|---|
| 2011/0010886 | A1 | 1/2011 | Arthey et al. |
| 2015/0101144 | A1 | 4/2015 | Bosses |
| 2016/0100725 | A1 | 4/2016 | Janssen, Jr. |
| 2016/0113458 | A1 | 4/2016 | Song |

(Continued)

FOREIGN PATENT DOCUMENTS

| | | |
|---|---|---|
| CN | 201119845 | 9/2008 |
| DE | 20 2004 012 610 | 1/2006 |
| EP | 2987445 | 2/2016 |

(Continued)

OTHER PUBLICATIONS

International Search Report and Written Opinion dated Aug. 10, 2018, directed to International Application No. PCT/GB2018/051313; 11 pages.

(Continued)

*Primary Examiner* — David Redding

(74) *Attorney, Agent, or Firm* — Morrison & Foerster LLP

(57) ABSTRACT

A suction nozzle for a vacuum cleaner includes a suction chamber; an outlet duct; an underside for engaging a surface to be cleaned; a main suction opening in the underside, which opens into the suction chamber; an auxiliary suction path which opens into the suction chamber; and a bleed path in fluid communication with the outlet duct. The suction nozzle further includes a valve mechanism arranged to open and close the auxiliary suction path and the bleed path, the valve mechanism being movable between a first configuration in which the auxiliary suction path is closed and the bleed path is open, a second configuration in which the auxiliary suction path is open and the bleed path is closed, and a third configuration in which both the auxiliary suction path and the bleed path are closed.

17 Claims, 8 Drawing Sheets

(56) References Cited

U.S. PATENT DOCUMENTS

2016/0270610 A1 9/2016 Kasper

FOREIGN PATENT DOCUMENTS

| | | |
|---|---|---|
| GB | 2 253 780 | 9/1992 |
| GB | 2536064 | 6/2017 |
| JP | 55-30689 | 2/1980 |
| JP | S0-33948 | 3/1985 |

OTHER PUBLICATIONS

Search Report dated Oct. 2, 2017, directed to GB Application No. 1707991.4; 1 page.

SUCTION NOZZLE

REFERENCE TO RELATED APPLICATIONS

This application claims the priority of United Kingdom Application No. 1707991.4, filed May 18, 2017, the entire contents of which are incorporated herein by reference.

FIELD OF THE INVENTION

The present invention relates to a suction nozzle of the type that can be used on a vacuum cleaner.

The invention is not limited to suction nozzles for any particular type of vacuum cleaner. For example, it includes both cleaner heads on upright vacuum cleaners and floor tools on cylinder vacuum cleaners or handheld vacuum cleaners.

BACKGROUND OF THE INVENTION

One way of characterizing the cleaning performance of a vacuum cleaner is by reference to its so-called 'pick-up' performance: the ability of the vacuum cleaner to pick up dirt and debris from a floor surface. A desirable pick-up performance often includes the ability to pick up both fine dirt as well as so-called 'large debris' such as, for example, certain pet snacks, breakfast cereals, grains of rice etc.

Some suction nozzles are provided with a 'large debris path', in addition to the main suction opening, which is designed to allow large debris to be drawn into the suction nozzle with reduced clogging or 'snowploughing'. However, air entering the suction nozzle through the large debris path means that the suction at the main suction opening is reduced. Pickup performance outside of large debris pickup may therefore be reduced. Some suction nozzle designs allow the large debris path to be closed when not needed, in order to mitigate this effect. However, the low pressure inside the suction nozzle with the large debris path closed can cause the suction nozzle to 'limpet'—sucking itself down onto a floor surface and therefore being difficult to manoeuvre. This effect could be combatted by including a 'bleed' path. This provides an additional route for air to be sucked into the suction nozzle, increasing the pressure within the suction nozzle and thereby reducing the chance that it will limpet. However, the provision of an additional route for air into the suction nozzle would further reduce suction at the main suction opening and thus potentially reduce overall performance.

SUMMARY OF THE INVENTION

It is an object of the invention to mitigate or obviate the above disadvantages, and or to provide an improved or alternative suction nozzle.

According to a first aspect of the present invention there is provided a suction nozzle for a vacuum cleaner, the suction nozzle comprising a suction chamber; an outlet duct extending from the suction chamber for connection to a vacuum source on the vacuum cleaner; an underside for engaging a surface to be cleaned; a main suction opening in the underside, which opens into the suction chamber; an auxiliary suction path which opens into the suction chamber; a bleed path in fluid communication with the outlet duct; and a valve mechanism arranged to open and close the auxiliary suction path and the bleed path, the valve mechanism being movable between a first configuration in which the auxiliary suction path is closed and the bleed path is open, a second configuration in which the auxiliary suction path is open and the bleed path is closed, and a third configuration in which both the auxiliary suction path and the bleed path are closed.

According to some embodiments, the present invention can therefore provide a suction nozzle with three different modes. This, in turn, can allow the suction nozzle to have improved versatility. For example, by placing the valve mechanism in the first configuration the suction nozzle can be tailored to normal use, with the auxiliary suction path being closed to improve suction power but with the bleed path open to avoid the suction nozzle being too difficult to move. By placing the valve mechanism in the second configuration the suction nozzle can be tailored to pick up large debris, with the auxiliary suction path open but with the bleed path closed so as to maximise suction through the auxiliary suction path and the main suction opening. By placing the valve mechanism in the third configuration the suction nozzle can be tailored to maximum suction power at the main suction opening at the expense of manoeuvrability (for example when cleaning a particularly badly soiled floor surface), with both the auxiliary suction path and the bleed path closed.

For the avoidance of doubt, reference to a path being 'closed' is not intended to be limited to that path necessarily being completely sealed. In some embodiments, however, the valve mechanism may be configured to seal the auxiliary suction path when in the first configuration, to seal the bleed path when in the second configuration, and/or to seal both the auxiliary suction path and the bleed path when in the third configuration. Similarly, reference to a path being 'open' is not intended to requite said path to be completely unobstructed by the valve mechanism.

For the avoidance of doubt, reference to the underside 'engaging' a surface to be cleaned is not intended to be limited to the underside necessarily being arranged to contact that surface.

The valve mechanism may have an actuating member which is movable so as to move the valve mechanism between configurations, the valve mechanism being in the first configuration when the actuating member is in a first position, the valve mechanism being in the second configuration when the actuating member is in a second position, and the valve mechanism being in the third configuration when the actuating member is in a third position.

The valve mechanism being movable between configurations by moving the actuating member between corresponding positions may be advantageously simple or intuitive for a user.

As an alternative, the valve mechanism may require manipulation of multiple components of the valve mechanism in order to move it between configurations.

The actuating member may be movable by hand.

This may provide an advantageously simple mechanism for moving the valve mechanism between configurations.

As an alternative, the actuating member may be movable using a tool (for instance the actuating member may be concealed within the suction nozzle and be movable by inserting a key into a corresponding aperture and rotating it). As another alternative, the actuating member may be movable electronically (for instance by an electric motor via an appropriate drive train)

The actuating member may exhibit an over-centre bias between at least two of said first, second and third positions.

The over-centre bias may provide a stabilising effect, acting to return the actuating member to one of the first, second and third positions when disturbed therefrom (for instance by a knock). The over-centre bias may also provide tactile feedback in embodiments where the actuating member is manually movable, allowing the user to feel when the actuating member has reached a desired position based on its resistance to manipulation.

Preferably, the actuating member exhibits an over-centre bias between the first, second and third positions.

The actuating member may be slidably movable between the first, second and third positions.

This may provide an intuitive mechanism for moving the actuating member, and/or a mechanism which is advantageously simple to manufacture.

The actuating member may be slidable linearly, or may be slidable along a curved path.

As an alternative, the actuating member may be rotatable between the first, second and third positions.

The suction nozzle may comprise at least two auxiliary suction paths, each of which opens into the suction chamber, and each of which is closed when the valve mechanism is in the first or third configuration and is open when the valve mechanism is in the second configuration.

Providing two auxiliary suction paths may provide more uniform suction power. For example, where the auxiliary suction paths are used as large debris paths, the provision of two such paths may allow large debris from a wider region around the suction nozzle to be sucked into the suction chamber, in contrast to a suction nozzle with a single suction path where large debris may only be sucked in from a more localised area. As another example, the auxiliary suction paths may be spaced about the suction chamber, meaning that the loss in suction at the main suction opening due to the presence of the auxiliary suction paths is more evenly distributed. The suction chamber would therefore have a more even level of suction across the main suction opening, in comparison to a suction nozzle with a single auxiliary suction path, which may have a localised area of low suction that could mean the suction nozzle would leave 'missed spots' as it is passed across a floor surface.

The at least two auxiliary suction paths are preferably spaced along the width of the suction chamber. For example, where the suction nozzle has two auxiliary suction paths these may be located at positions around ⅓ and ⅔ of the width of the suction chamber. As another example where the suction nozzle has two auxiliary suction paths, these may be located at positions around ¼ and ¾ of the width of the suction chamber.

The suction nozzle may comprise at least two bleed paths, each of which is in fluid communication with the outlet duct, and each of which is open when the valve mechanism is in the first configuration and is closed when the valve mechanism is in the second or third configuration.

Providing two bleed paths may provide more uniform suction power at the main suction path. For example, the bleed paths may be spaced about the suction chamber, meaning that the loss in suction at the main suction opening due to the presence of the bleeds is more evenly distributed. The suction chamber would therefore have a more even level of suction across the main suction opening, in comparison to a suction nozzle with a single bleed path, which may have a localised area of low suction that could mean the suction nozzle would leave 'missed spots' as it is passed across a floor surface.

The at least two bleed paths are preferably spaced along the width of the suction chamber.

The or each auxiliary suction path may lead to the suction chamber from an entrance at a front of the suction nozzle for admitting debris as the suction nozzle is pushed in a forward direction.

The auxiliary suction paths having entrances at the front of the suction nozzle may be advantageous in that they can be more easily be positioned by a user. For example, where the auxiliary suction paths are configured as large debris paths, their entrances being at the front of the suction nozzle means that the user can simply 'steer' the vacuum cleaner so that the suction nozzle runs forwards over the large debris in order for the large debris paths to suck up the debris.

As an alternative, the or each auxiliary suction path may lead to the suction chamber from an entrance at a different part of the suction nozzle, for instance a side or a rear of the suction nozzle.

The or each auxiliary suction path may define a narrowest point, the narrowest point being at least 5 mm in diameter, preferably at least 6 mm or at least 8 mm in diameter.

This may allow the auxiliary suction paths to function particularly well as large debris suction paths. This relatively large clearance reduces the risk of large debris being trapped at the narrowest point of an auxiliary suction path and clogging it.

The narrowest point of an auxiliary suction path may be considered to be the point along the length of the auxiliary suction path at which its diameter is shortest. For instance in an auxiliary suction path of uniform circular cross section, the narrowest point is equal to the diameter of that circle. In an auxiliary suction path of uniform rectangular cross section, the narrowest point is equal to the length of the short side. In an auxiliary suction path of non-constant cross-section, the narrowest point is the narrowest diameter at the point along the length of the auxiliary suction path which is most tightly constricted. In other words, the narrowest point of an auxiliary suction path may be considered to be the minimum clearance between opposing walls defining that auxiliary suction path.

Although it can beneficial for the narrowest point of the or each auxiliary suction path to be relatively large to avoid clogging, it can also be beneficial for the narrowest point to be relatively narrow so as reduce the reduction in suction that the main suction inlet experiences due to airflow through the auxiliary suction paths. Accordingly, it may be preferable for the narrowest point to be less than 15 mm, for instance less than 10 mm.

The or each auxiliary suction path may lead to the suction chamber from an entrance which tapers from a wider upstream portion to a narrower downstream portion.

The tapered entrance of an auxiliary suction path can provide a funneling effect. For instance, where an auxiliary suction path is configured as a large debris path, the tapered entrance can act to funnel large debris into the auxiliary suction path.

In some embodiments the entire auxiliary suction path, rather than just its entrance, may be tapered.

The or each auxiliary suction path may be defined by an open-bottomed channel formed in the underside of the suction nozzle.

In auxiliary suction path defined by an open-bottomed channel, a floor surface being cleaned effectively becomes the bottom wall of the auxiliary suction path during use. This, in turn, can increase the amount of dust which can be sucked into the auxiliary suction path, in contrast to a fully-enclosed auxiliary suction path where some dirt can escape by passing under the bottom wall of the path.

The or each bleed path may be configured to allow air with substantially no entrained dirt to enter the suction nozzle during normal use. To achieve this, the entrance to the bleed path may be positioned so that it is spaced from a floor surface during normal use. For instance, the or each bleed path may lead towards the outlet duct from an entrance on an upper surface of the suction nozzle.

This can reduce the risk of the bleed path being clogged by dirt.

Preferably, the entrance to the or each bleed path faces generally upwards. This can reduce the risk of the bleed paths being blocked during use, for instance in comparison to a suction nozzle the entrance of which is forward-facing which may be blocked when the suction nozzle is pushed forwards into a wall or a piece of furniture.

The or each bleed path may be in fluid communication with the outlet duct via the suction chamber.

This may allow the valve mechanism to be advantageously simple or compact, for example in comparison to an arrangement where the bleed paths are positioned away from the suction chamber and the valve mechanism must extend over a greater distance in order to open/close both the auxiliary suction paths and the bleed paths. As well or instead, this may allow the shape of the bleed paths to be advantageously simple, and thus cheap to produce, in comparison to arrangements where the bleed paths must have a convoluted shape which leads to the outlet duct while circumventing the suction chamber.

The suction nozzle may further comprise an agitator inside the suction chamber for agitating the surface to be cleaned through the main suction opening.

This may increase the extent to which dirt engrained within carpet fibres can be separated therefrom and sucked into the suction chamber.

The suction nozzle may further comprise a further fluid path, the further fluid path being in fluid communication with the outlet duct.

This may further increase the versatility of the suction nozzle. For example, the further fluid path may be provided at a lower edge of a side of the suction nozzle, thereby increasing the effectiveness of the suction nozzle in lifting dirt from a corner between a wall and a floor surface when the suction nozzle is run across the floor surface next to the wall. As another example, the further fluid path may be provided in a position which allows relatively clean air to enter the suction nozzle. Such a path would likely not improve pickup performance, but would increase the pressure in the suction chamber and therefore reduce the risk that the suction nozzle will 'limpet'.

The further fluid path may be in fluid communication with the outlet duct via the suction chamber.

The further fluid path may be unaffected by movement of the valve mechanism between the first, second and third configurations. For instance, the further fluid path may be permanently open.

The suction nozzle would allow some volume of airflow to enter the suction chamber through a path other than the main suction opening, regardless of the configuration of the valve mechanism. This can reduce the risk of lack of airflow leading to overheating of the vacuum motor of a vacuum cleaner to which the suction nozzle is attached. For instance, if airflow through the main suction opening, auxiliary suction paths and bleed paths in combination was unduly restricted (for instance if the valve mechanism was in the third position and the main suction opening was excessively constricted by being pressed hard into a floor surface), sufficient airflow to cool the vacuum motor may enter the suction nozzle through the further fluid path. This would not be the case if the user could close the further fluid path (either using the valve mechanism or through a separate mechanism)

The suction nozzle may comprise more than one further fluid path. For instance, the suction nozzle may have one further fluid path at a lower edge of one side of the suction nozzle (as described above), and another further fluid path at a lower edge of the other side of the suction nozzle.

According to a second aspect of the present invention there is provided a vacuum cleaner comprising a suction nozzle according to the first aspect of the invention.

This may provide a vacuum cleaner the suction nozzle of which provides one or more of the advantages discussed above.

The vacuum cleaner may be, for example, of the 'upright', 'cylinder', 'handheld', 'stick' or 'lift-away' type.

BRIEF DESCRIPTION OF THE DRAWINGS

Embodiments of the present invention will now be described, by way of example only, with reference to the accompanying drawings in which.

Throughout the description and drawings, corresponding reference numerals denote corresponding features.

DETAILED DESCRIPTION OF THE INVENTION

Figure 1:
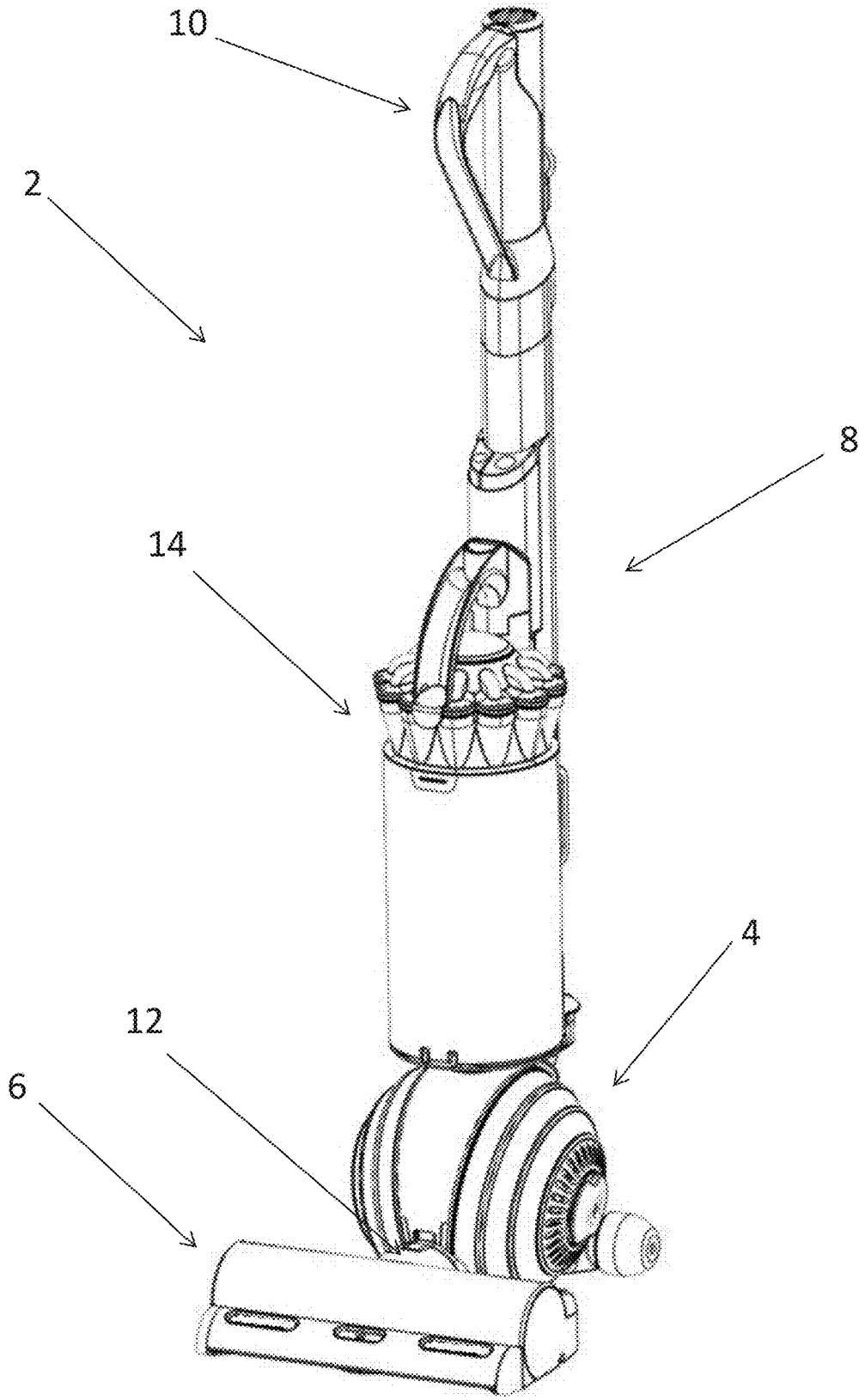
FIG. 1 is a perspective view of a vacuum cleaner according to an embodiment of the invention.

FIG. 1 shows a vacuum cleaner 2 according to an embodiment of the invention. The vacuum cleaner 2 of this embodiment is an upright vacuum cleaner. It has a rolling assembly 4 which carries a suction nozzle 6, and an 'upright' body 8. The upright body 8 can be reclined relative to the head assembly 4, and includes a handle 10 for maneuvering the vacuum cleaner 2 across the floor. In use, a user grasps the handle 10 and reclines the upright body 8 until the handle 10 is disposed at a convenient height. The user can then roll the vacuum cleaner 2 across the floor using the handle 10 in order to pass the suction nozzle 6 over the floor and pick up dust and debris therefrom. The dust and debris is drawn into the suction nozzle by a suction generator in the form of a motor-driven fan (not visible) housed on board the vacuum cleaner 2, and is ducted in conventional manner under the fan-generated suction pressure from an outlet duct 12 of the suction nozzle to a cyclonic separating apparatus 14 where dirt is separated from the air. The relatively clean air is then exhausted back to the atmosphere.

Figure 2:
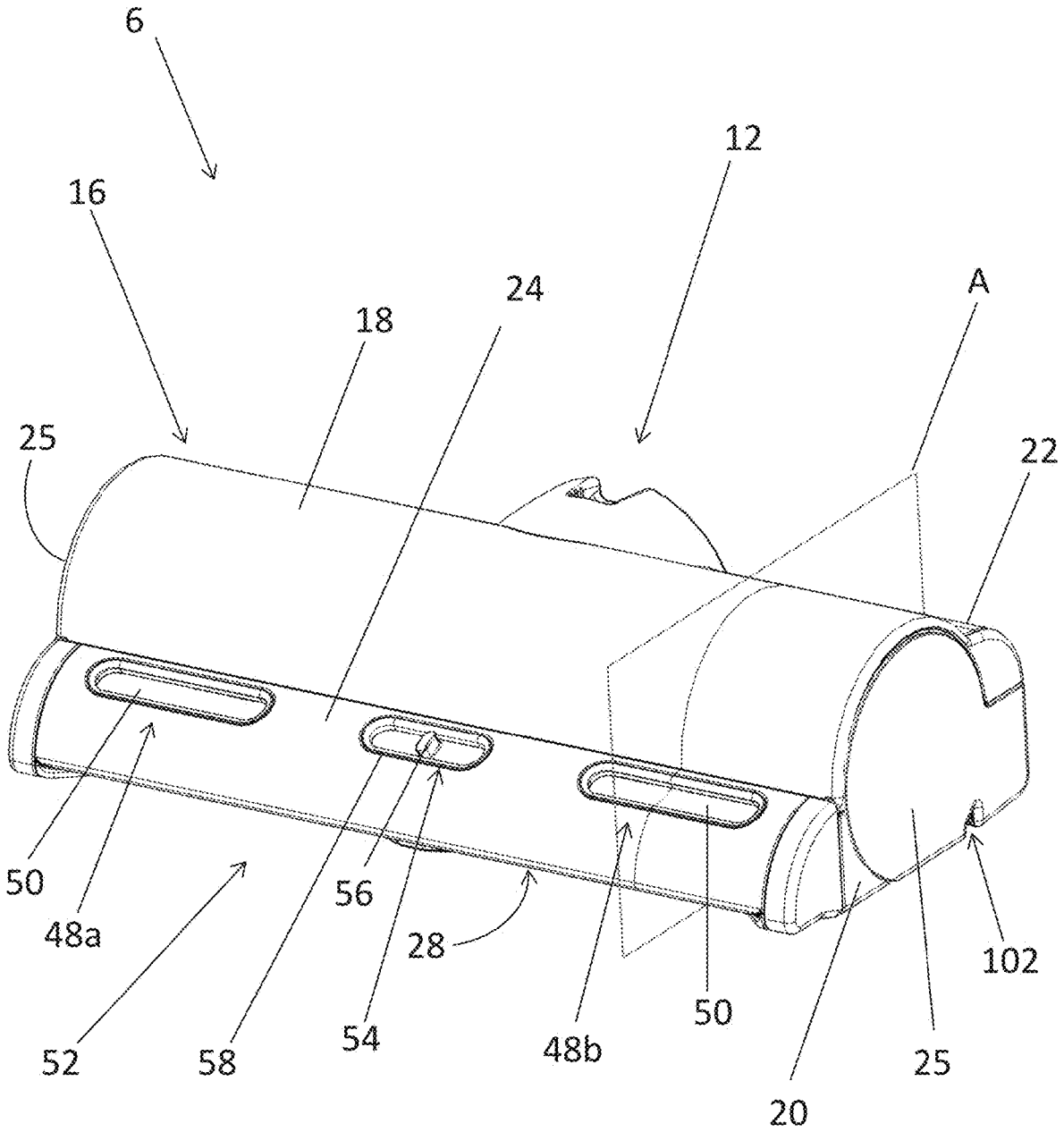
FIG. 2 is a perspective view from above of the suction nozzle of the vacuum cleaner of FIG. 1.
Figure 3:
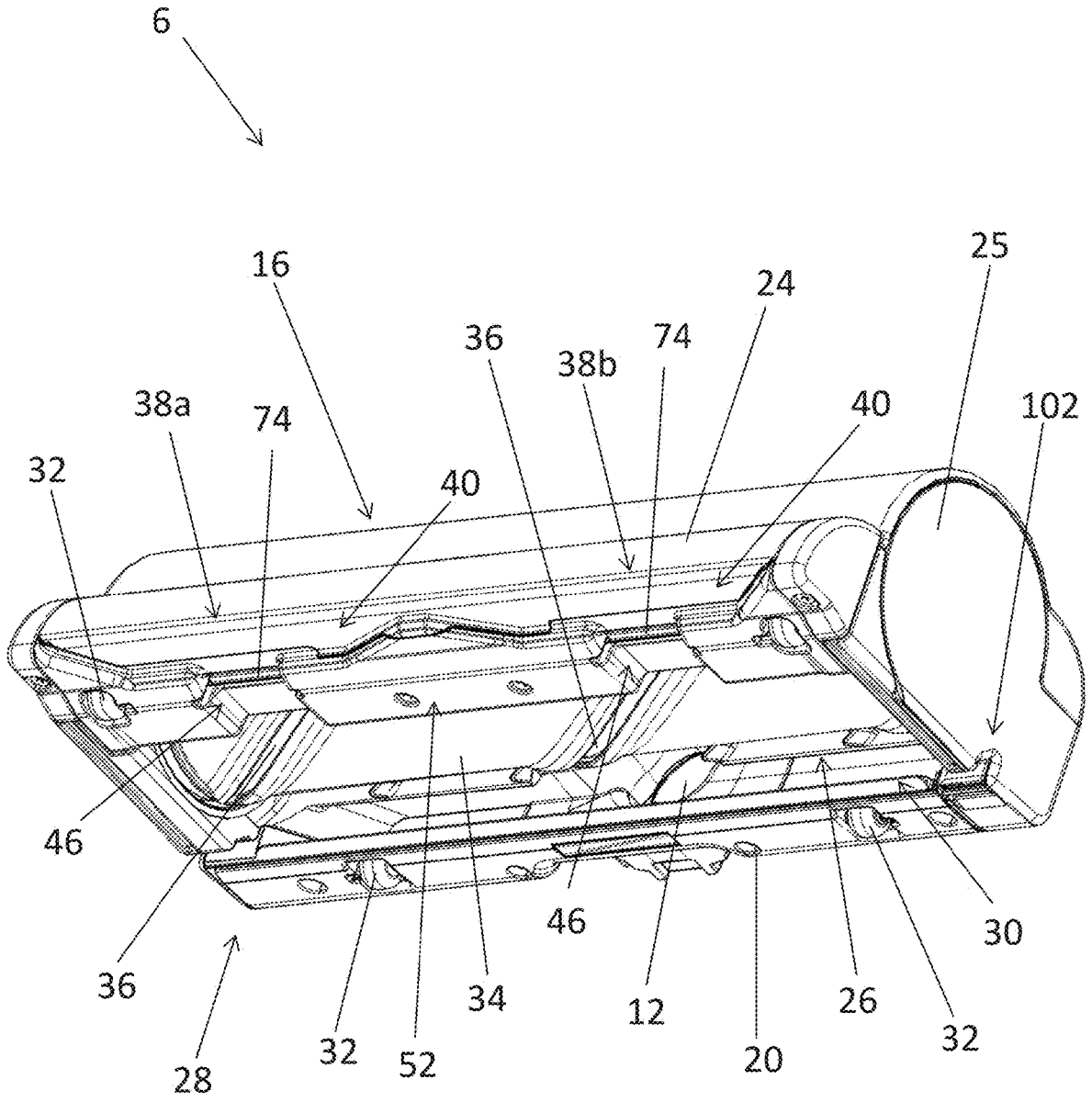
FIG. 3 is a perspective view from underneath of the suction nozzle of FIG. 2.

The suction nozzle 6 is shown in isolation in FIGS. 2 and 3. It has a housing 16 which includes an upper housing 18, a lower housing 20, a rear housing 22, a front housing 24 and two side plates 25. The housing 16 defines a suction chamber 26 from which the outlet 12 extends. The housing 16 also defines an underside 28 for engaging a surface to be cleaned, which in this embodiment takes the form of a sole plate. A main suction opening 30, which opens into the suction chamber 26, is provided in the sole plate 28. The main suction opening 30 provides an entrance for dirt-laden air to enter the suction nozzle 6 (more particularly the suction chamber 26 of the suction nozzle) before being drawn out of the suction nozzle through the outlet 12 as described above.

In this embodiment, when the sole plate 28 engages a hard surface such as a laminate floor, the suction nozzle 6 is supported by wheels 32 projecting through the sole plate 28, and the sole plate is spaced slightly above the floor surface. However, when the suction nozzle 6 is resting on a carpet, the wheels 32 sink into the pile of the carpet and the sole plate 28 contacts the carpet. This allows carpet fibres to protrude into the main suction opening 30, whereupon they are disturbed by an agitator 34 positioned within the suction chamber 26 so as to loosen dirt and dust therefrom.

The agitator 34 of this embodiment is hollow and generally cylindrical, with helical grooves 36 configured to support arrays of agitating bristles (not shown). The agitator 34 is able to rotate within the suction chamber 26, under action of an electric motor (not visible) housed inside it.

The suction nozzle 6 has two auxiliary suction paths 38*a*, 38*b* which are generally the same as one another in structure and function. The auxiliary suction paths 38*a*, 38*b* are spaced along with width of the suction chamber 26. More particularly, one auxiliary suction path 38*a* is positioned around ¼ of the way along the width of the suction chamber 26 and the other auxiliary suction path 38*b* is positioned around ¾ of the way along the width of the suction chamber.

Each auxiliary suction path 38*a*, 38*b* extends from an entrance 40 at the front of the suction nozzle 6 (i.e. the part of the suction nozzle that faces forwards from the perspective of the user during normal use), and opens into the suction chamber 26. Each auxiliary suction path 38*a*, 38*b* is defined by an open-bottomed channel formed in the underside 28 in that each path has a top wall and side walls, but no bottom wall. In use, the bottom wall of each auxiliary suction path 38*a*, 38*b* is formed by the surface being cleaned.

The entrance 40 of each auxiliary suction path 38*a*, 38*b* tapers from a wider upstream portion (at the front of the entrance) to a narrower downstream portion (at the rear of the entrance). Extending between the entrance 40 of each auxiliary suction path 38*a*, 38*b* and the suction chamber 26 is a passage 46 of generally rectangular cross section.

The auxiliary suction paths 38*a*, 38*b* of this embodiment are configured to form large debris paths. They are therefore relatively large in cross section, to allow large debris to pass through them and into the suction chamber 26. The narrowest point of each auxiliary suction path 38*a*, 38*b* in this particular case is the height of its passage 46 (i.e. the distance between the top wall of the passage and a surface being cleaned), which is around 6 mm.

The suction nozzle also has two bleed passages 48*a*, 48*b* which are generally the same as one another in form and function. The two bleed passages 48*a*, 48*b*, like the auxiliary suction paths 38*a*, 38*b*, are spaced along the width of the suction chamber 26. Each bleed passage 48*a*, 48*b* is in fluid communication with the outlet duct 12 of the suction nozzle. In this case the bleed passages 48*a*, 48*b* each open into the suction chamber 26. The bleed passages 48*a*, 48*b* are therefore in fluid communication with the outlet duct 12 via the suction chamber 26.

Each bleed passage 48*a*, 48*b* extends from an entrance in the form of a section of finely-perforated mesh 50. Each entrance 50 is positioned on an upper surface of the suction nozzle, more particularly on an upper surface of the front housing 24. Each entrance 50 faces generally upwards, in this case at an angle of around 25 degrees to the vertical.

Figure 4:
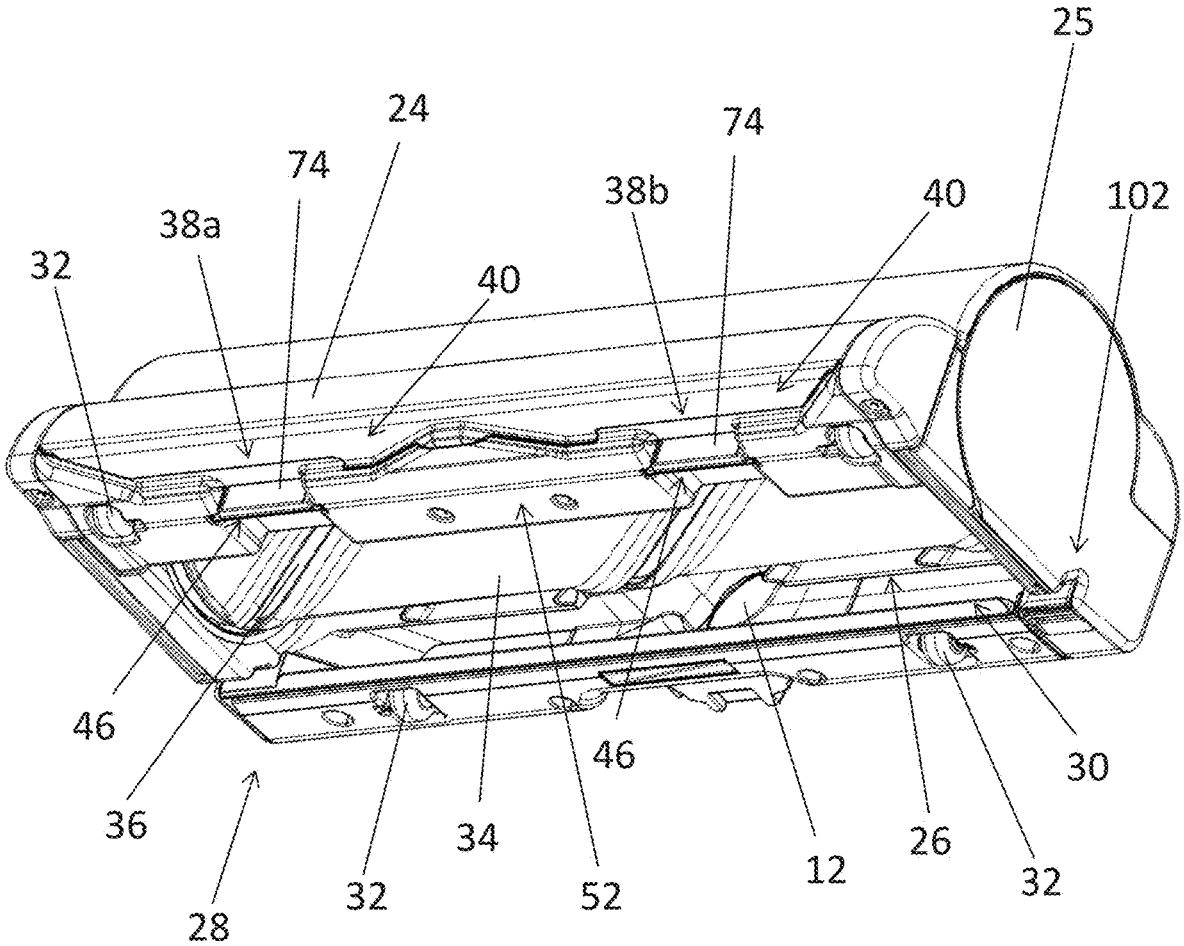
FIG. 4 is a perspective view from underneath of the suction nozzle of FIGS. 2 and 3, with auxiliary suction paths closed.

The suction nozzle 6 has a valve mechanism 52 which is arranged to selectively open and close the auxiliary suction paths 38*a*, 38*b* and the bleed paths 48*a*, 48*b*. In this embodiment the valve mechanism 52 is housed in the front housing 24. The valve mechanism 52 is movable between three different configurations, with the auxiliary suction paths 38*a*, 38*b* and the bleed paths 48*a*, 48*b* being open or closed in different combinations depending on the configuration of the valve mechanism. When the valve mechanism 52 is in a first configuration the auxiliary suction paths 38*a*, 38*b* are closed and the bleed paths 48*a*, 48*b* are open. When the valve mechanism 52 is in a second configuration the auxiliary suction paths 38*a*, 38*b* are open and the bleed paths 48*a*, 48*b* are closed. When the valve mechanism 52 is in a third configuration, both the auxiliary suction paths 38*a*, 38*b* are and the bleed paths 48*a*, 48*b* are closed. FIGS. 1-3 show the valve mechanism 52 in its second configuration—the auxiliary suction paths 38*a*, 38*b* are open (and the bleed paths 48*a*, 48*b* are closed, although this is not visible in these figures). FIG. 4 shows the suction nozzle 6 with the auxiliary suction paths 38*a*, 38*b* closed, meaning that the valve mechanism 52 is in the first or third configuration.

Figure 5:
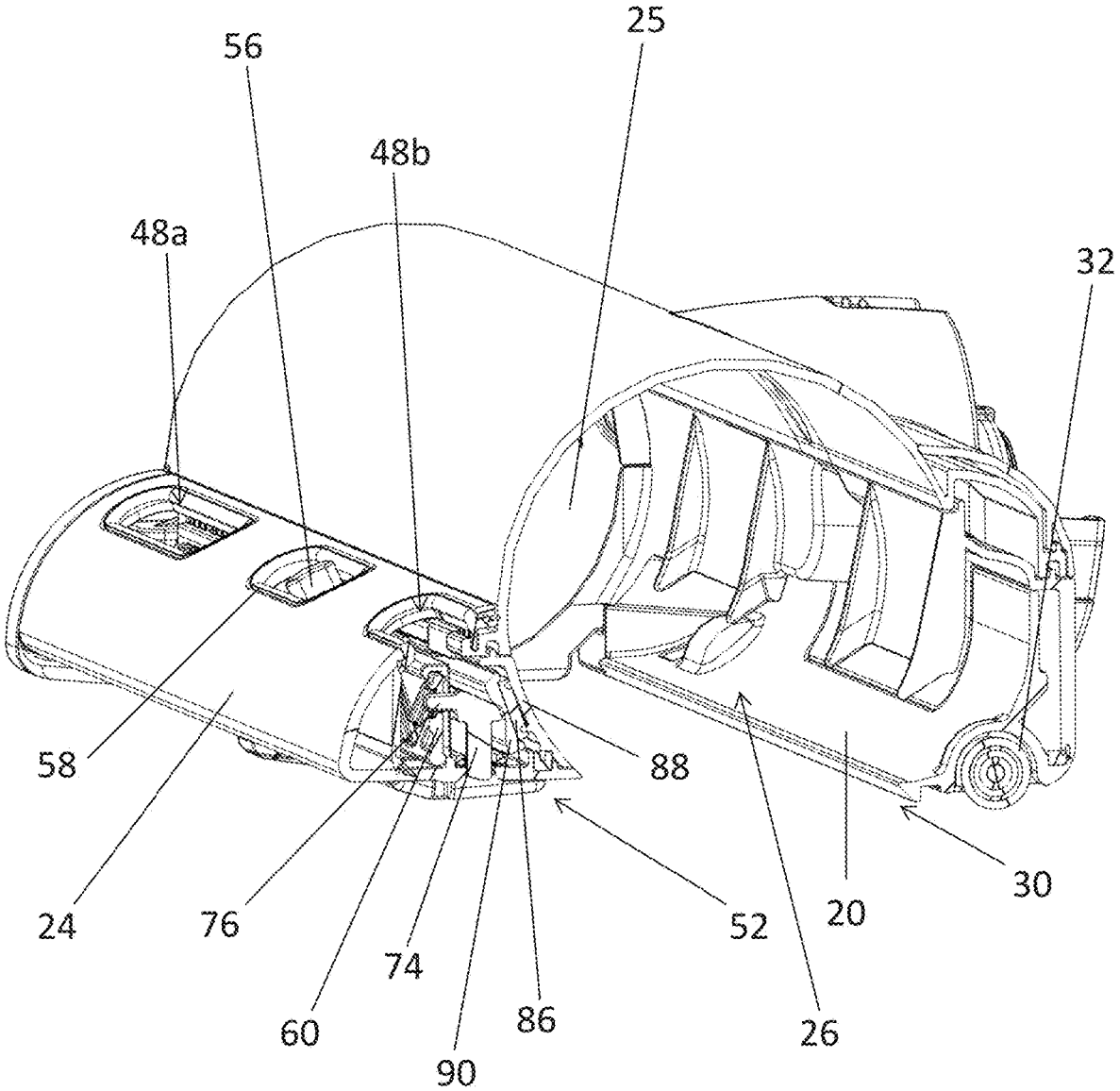
FIG. 5 is a cross section of the suction nozzle of FIGS. 2-4, with a brush bar, motor and drive train having been removed, angled forwards.
Figure 6:
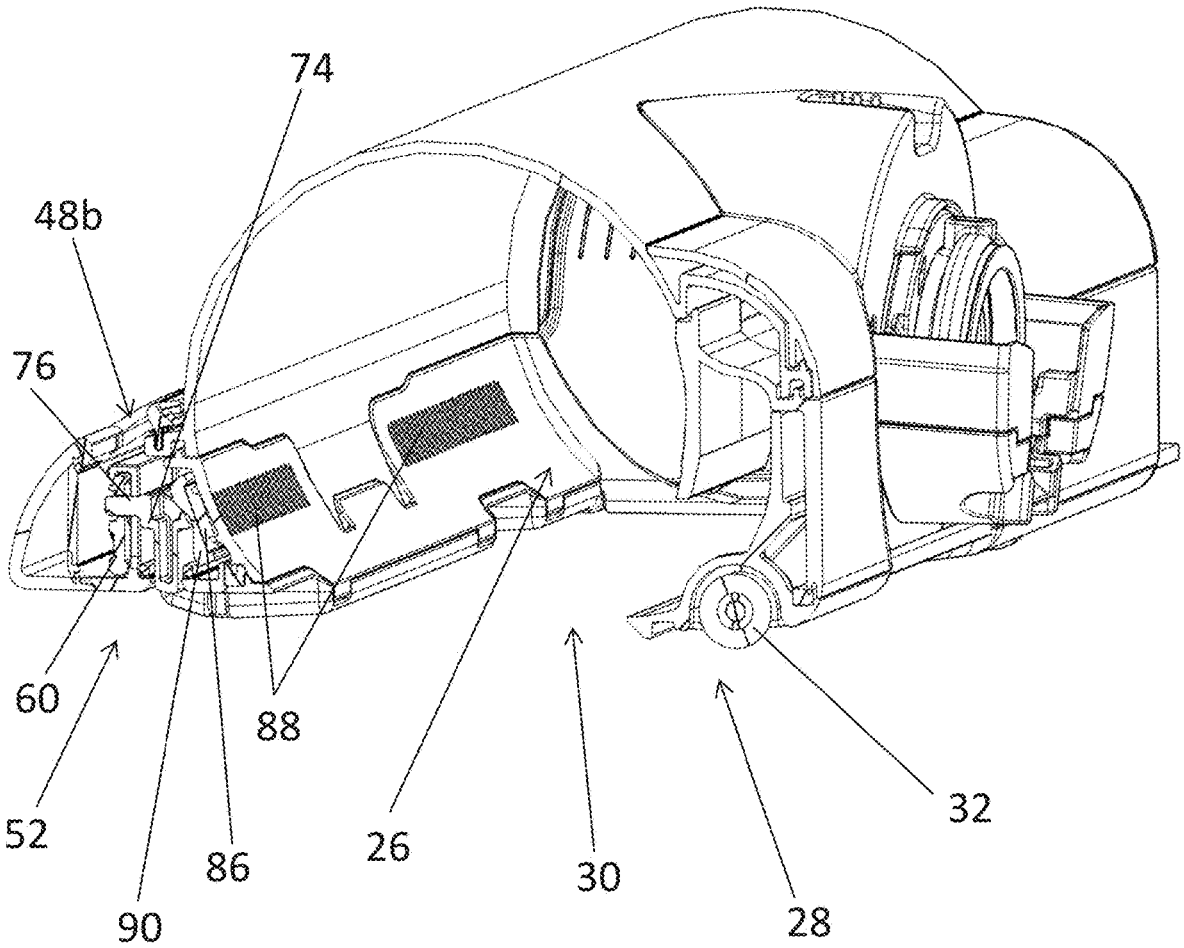
FIG. 6 is a cross section of the suction nozzle of FIGS. 2-4, with a brush bar, motor and drive train having been removed, angled backwards.
Figure 7:
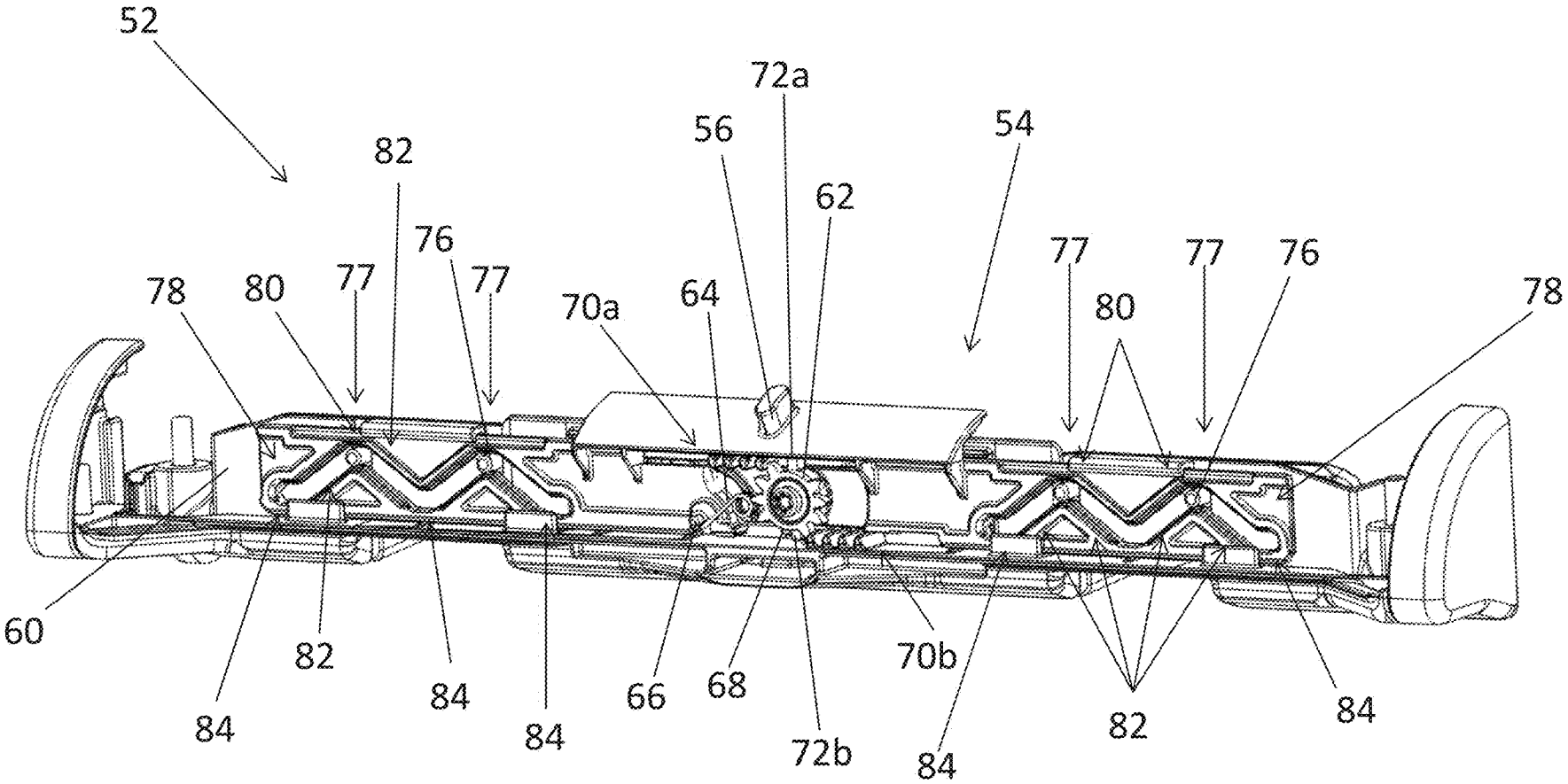
FIG. 7 is a front perspective view of a valve mechanism of the suction nozzle of FIGS. 2-4.
Figure 8:
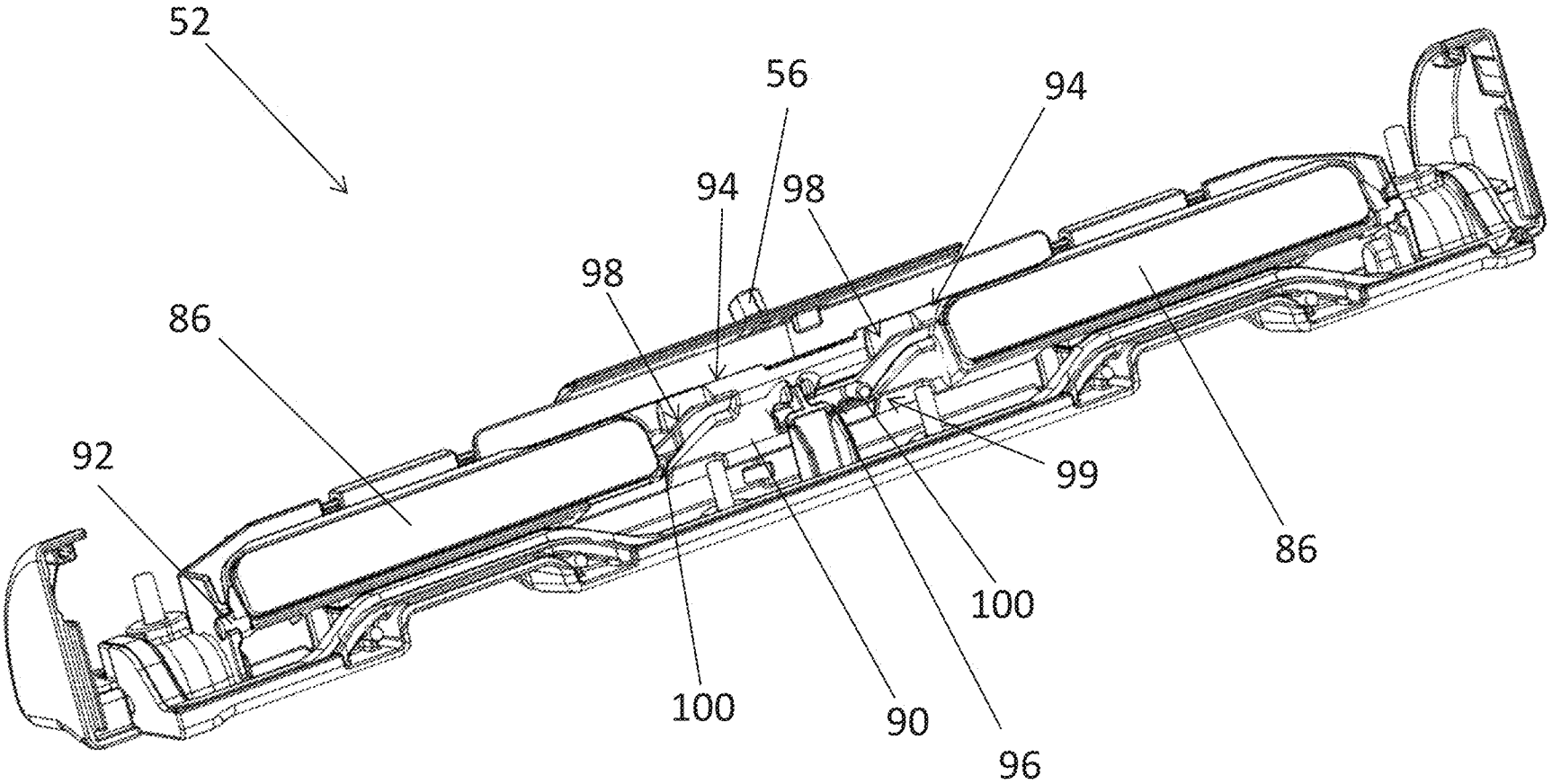
FIG. 8 is a rear perspective view of a valve mechanism of the suction nozzle of FIGS. 2-4.

FIGS. 5 and 6 show cross-sections through the suction nozzle with the perforated mesh, agitator, motor and associated drive train removed for clarity. FIGS. 7 and 8 show the contents of the front housing, from the front and rear respectively. The structure and function of the valve mechanism will now be described with reference to these figures in combination with FIGS. 2-4.

The valve mechanism 52 has an actuating member 54 by which is movable between positions so as to move the valve mechanism between its three configurations. The actuating member 54 is movable to a first position to move the valve mechanism 52 to the first configuration, to a second position to move the valve mechanism to the second configuration, and to a third position to move the valve mechanism to the third configuration.

The actuating member 54 has a handle portion 56 which projects through an aperture 58 in the front housing 24, allowing the actuating member to be moved by hand between its three positions. FIGS. 1-3 and 5-8 show the actuating member 54 in a the second position (meaning that the valve mechanism 52 is in the second configuration—the auxiliary suction paths 38*a*, 38*b* are open and the bleed paths 48*a*, 48*b* are closed). In this embodiment, the actuating member 54 is slidable movable in a straight line between the first, second and third positions. From the second position as shown in FIGS. 1-3 and 5-8, the actuating member 54 can be slid to the right on the suction nozzle 6 (i.e. to the left from the perspective of FIG. 2) to move the actuating member to the first position and therefore move the valve mechanism 52 to the first configuration. This would close the auxiliary suction paths 38*a*, 38*b* and open and the bleed paths 48*a*, 48*b*. Similarly, from the second position the actuating member 54 can be slid to the left on the suction nozzle 6 (i.e. to the right from the perspective of FIG. 2) to move the actuating member to the third position and therefore move the valve mechanism 52 to the third configuration. This would close the auxiliary suction paths 38*a*, 38*b* and leave the bleed paths 48*a*, 48*b* closed.

As well as the handle portion 56, the actuating member 54 has a chassis 60 positioned inside the front housing 24. The chassis 60 is integrally formed with the handle portion 56, and is slidable laterally within the front housing 24 in the same manner as the handle portion 56 is slidable laterally within the aperture 58. It is the movement of the chassis 60 which causes the auxiliary suction paths 38*a*, 38*b* and bleed paths 48*a*, 48*b* to be opened and closed as the valve mechanism 52 is moved between configurations, as described in more detail later.

The actuating member 54 also comprises a cog 62 rotatably mounted to the chassis 60, and a biasing member in the form of a spring 64. The spring 64 is mounted at one end to a stub 66 on the chassis 60, and at its other end to a stub 68 on the cog 62. The spring 64 acts to urge the stubs 66, 68 away from each other.

The front housing 22 has two racks of teeth 70*a*, 70*b* positioned to mesh with the cog. The cog 62, spring 64 and teeth 70*a*, 70*b* co-operate to allow the actuating member 54 to exhibit an over-centre bias between the first, second and third positions. More particularly, in this case the actuating member 54 exhibits an over-centre bias between the first and second positions, and between the second and third positions, as outlined below.

With the actuating member 54 in the second position, as shown in FIG. 7, the spring 64 urging the stubs 66, 68 apart urges the cog 62 to rotate in a first direction (anticlockwise from the perspective of FIG. 7). However, stop members 72*a*, 72*b* on the cog 62 contact the teeth 70*a*, 70*b* and prevent this movement. The actuating member 54 is therefore held in the second position.

When a user starts to slide the actuating member 54 from the second position to the first position, the cog 62 begins to run across teeth 70*a*. The teeth 70*a* cause the cog 62 to rotate in a second direction which is the opposite direction to the first direction (i.e. clockwise from the perspective of FIG. 7). This pushes the stubs 66, 68 together, against the bias of the spring 64. The user therefore feels more resistance to the motion of the actuating member 54. As the user continues to move the actuating member 54 and the cog 62 continues to rotate, the stub 68 on the cog reaches a position as close as it can get to the stub 66. This is the 'centre' of the over-centre bias of the actuating member 54 between the first and second positions. As the actuating member 54 continues to move towards the first position past this point, the restorative force of the spring 64 urging the stubs 66, 68 apart urges the cog 62 to continue to rotate in the second direction. The cog therefore bears on the teeth 70*a* and urges the actuating member away from the second position and towards the first position. In some embodiments the force from the spring may be sufficient to move the actuating member 54 to the first position. In this case, however, the force from the spring assists in this movement but the user must continue to apply a force in order to overcome the frictional resistance to movement of the actuating member 54. Nonetheless, the user received tactile feedback as they can feel the movement of the actuating member 54 becoming easier.

When the actuating member reaches the first position, the stop member 72*b* contacts the teeth 70*a*. This prevents the cog 62 from rotating any further in the second direction. The actuating member 54 therefore 'settles' in the first position. If the user were then to move the actuating member 54 from the first position and towards the second position, the teeth 70*a* would urge the cog to rotate in the first direction. This would move the stubs 66, 68 towards one another, against the bias of the spring 64, therefore the spring would resist movement of the actuating member towards the second position. Once the actuating member 54 passed the 'centre' point discussed above, the spring 64 urging the stubs 66, 68 apart would urge the cog 62 to rotate in the first direction, which would urge the actuating member 54 towards the second position.

The over-centre bias of the actuating member 54 between the second and third positions is produced in generally in the same way as the over-centre bias between the first and second positions. However, between the second and third positions the cog 62 interacts with teeth 70*b* rather than teeth 70*a*. The cog 62 rotates in the second direction when the actuating member 54 moves from the second position to third position, as it does when the actuating member moves from the second position to the third position. Likewise, the cog 62 rotates in the first direction when the actuating member 54 moves from the third position to the second position, as it does when the actuating member moves from the first position to the second position.

The valve mechanism 52 opens and closes each auxiliary suction path 38*a*, 38*b* using a corresponding vertically-movable gate 74. When the valve mechanism 52 is in the first or the third configuration the gates 74 are in a lowered position, in which they block the passage 46 of the associated auxiliary suction path 38*a*, 38*b* and substantially prevent airflow therethrough. When the valve mechanism 52 is in the in the second configuration, the gates 74 are in a raised position in which the passages 46 of the auxiliary suction paths 38*a*, 38*b* is substantially unobstructed.

The position of the gates 74 of the valve mechanism 52 is determined by the position of the actuating member 54. Each gate 74 has a pair of pins 76 which project through vertical guide slots 77 into a generally M-shaped slot 78 in the chassis 60 of the valve mechanism. The pins 76 being received in the guide slots 77 means that the pins (and thus the gates 74) can only move vertically. With the actuating member 54 in the second position, the pins 76 are held in upper peaks 80 in the slot 78. If the actuating member 54 is then moved to the first position on the third position, as the chassis 60 moves laterally, angled portions 82 of the slot urge the pins 76, and thus the gates 74, downwards. The pins 76 are then received in lower troughs 84 of the slots 78. Similarly, if the actuating member 54 is moved from the first or third position to the second position, as the chassis moves laterally the angled portions 82 urge the pins (and thus the gates 74) upwards. The pins are then received in the upper peaks 80 of the slots 78.

The valve mechanism 52 opens and closes each bleed path 48*a*, 48*b* using a corresponding sealing pad 86 which seals against a grille 88 through which that bleed path opens into the suction chamber 26. When the valve mechanism 52 is in the second or third configuration the sealing pads 86 are held against their respective grilles 88. When the valve mechanism 52 is in the first configuration, the sealing pads 86 are spaced apart from the grilles 88 so that air can flow through the bleed paths 48*a*, 48*b*, in through their respective entrances 50 and out into the suction chamber 26 through their respective grilles 88.

The position of the sealing pads 86 of the valve mechanism 52 is determined by the position of the actuating member 54. Both sealing pads 86 are provided on a rocker member 90 which can pivot about an axle 92 held in the front housing 24. The rocker member 90 has a pair of slots 94, each of which has a horizontal portion 96 and an angled portion 98 that meet at an intersection 99. Each slot receives a pin 100 which extends rearwardly from the chassis 60 of the actuating member 54. As the actuating member 54 slides laterally between the first, second and third positions, the pins 100 move laterally as well.

With the actuating member in the second position, the pins 100 are received in the intersections 99 of their respective slots 94 and the sealing pads 86 are held against the grilles 88 by the rocker member 90. If the actuating member 54 is moved from the second position to the third position, the pins 100 move to the right from the perspective of FIG. 8. As the pins 100 move, they bear on the angled portions 98 of their respective slots and cam the slots downwards. This camming action is accommodated by the rocker member 90 pivoting forwards about the axle 92, which moves the slots 94 down and also moves the sealing pads 86 forwards away from the grilles 88 (which, in turn, allows air to flow through the bleed paths 48*a*, 48*b*).

When the valve mechanism 52 is in the first configuration, the pins 100 are received in the ends of the angled portions 98 of their respective slots. If the valve mechanism 52 is then moved to the second configuration, the pins 100 move to the left from the perspective of FIG. 8. The pins therefore bear on the angled portions 98 of the slots 94 and cam them upwards. This camming action is accommodated by the rocker member pivoting backwards about the axle, which moves the slots 94 up and presses the sealing pads 86 against the grilles.

If the valve mechanism 52 is moved from the second configuration to the third configuration, the pins 100 move to the left from the perspective of FIG. 8. The pins 100 therefore travel along the horizontal portions 96 of their respective slots 94, and do not move the rocker member 90. The sealing pads 86 therefore remain pressed against the grilles 88 and the bleed paths 48*a*, 48*b* remain closed.

Returning briefly to FIGS. 2-4, it is noteworthy that the suction nozzle 6 of this embodiment also comprises two further fluid paths 102. A further fluid path 102 is provided at a lower edge of each side plate 25. The further fluid paths 102 are in fluid communication with the outlet duct 12, in this case via the suction chamber 26. In this embodiment the further fluid paths 12 are positioned to suck dust from the corner between a floor surface and a wall by running the suction nozzle 6 along the floor surface next to the wall.

The further suction paths 102 are not affected by the configuration of the valve mechanism 25 (nor can they be closed by any other mechanism). They are permanently open, so air can flow through them into the suction chamber 26 regardless of whether the auxiliary suction paths 38*a*, 38*b* or bleed paths 48*a*, 48*b* are open or closed.

It will be appreciated that numerous modifications to the above described embodiments may be made without departing from the scope of invention as defined in the appended claims. For instance, in other embodiments the vacuum cleaner may utilise a bag or a filter instead of (or as well as) a cyclonic separating apparatus.

The invention claimed is:

1. A suction nozzle for a vacuum cleaner, the suction nozzle comprising:

a suction chamber;

an outlet duct extending from the suction chamber for connection to a vacuum source on the vacuum cleaner;

an underside for engaging a surface to be cleaned;

a main suction opening in the underside, which opens into the suction chamber;

an auxiliary suction path which opens into the suction chamber;

a bleed path in fluid communication with the outlet duct; and a valve mechanism arranged to open and close the auxiliary suction path and the bleed path, the valve mechanism being movable between a first configuration in which the auxiliary suction path is closed and the bleed path is open, a second configuration in which the auxiliary suction path is open and the bleed path is closed, and a third configuration in which both the auxiliary suction path and the bleed path are closed.

2. The suction nozzle of claim 1, wherein the valve mechanism has an actuator that is movable so as to move the valve mechanism between configurations, the valve mechanism being in the first configuration when the actuating member is in a first position, the valve mechanism being in the second configuration when the actuator is in a second position, and the valve mechanism being in the third configuration when the actuator is in a third position.

3. The suction nozzle of claim 2, wherein the actuator is movable by hand.

4. The suction nozzle of claim 2, wherein the actuator exhibits an over-centre bias between at least two of the first, second, and third positions.

5. The suction nozzle of claim 2, wherein the actuator is slidably movable between the first, second, and third positions.

6. The suction nozzle of claim 1, wherein the suction nozzle comprises at least two auxiliary suction paths, each of the at least two auxiliary suction paths opens into the suction chamber, and each of each of the at least two auxiliary suction paths is closed when the valve mechanism is in the first or third configuration and is open when the valve mechanism is in the second configuration.

7. The suction nozzle of claim 1, wherein the suction nozzle comprises at least two bleed paths, each of the at least two bleed paths is in fluid communication with the outlet duct, and each of at least two bleed paths is open when the valve mechanism is in the first configuration and is closed when the valve mechanism is in the second or third configuration.

8. The suction nozzle of claim 1, wherein the auxiliary suction path leads to the suction chamber from an entrance at a front of the suction nozzle for admitting debris as the suction nozzle is pushed in a forward direction.

9. The suction nozzle of claim 1, wherein the auxiliary suction path defines a narrowest point, the narrowest point being at least 5 mm in diameter.

10. The suction nozzle of claim 1, wherein the auxiliary suction path leads to the suction chamber from an entrance which tapers from a wider upstream portion to a narrower downstream portion.

11. The suction nozzle of claim 1, wherein the auxiliary suction path is defined by an open-bottomed channel formed in the underside of the suction nozzle.

12. The suction nozzle of claim 1, wherein the bleed path leads towards the outlet duct from an entrance on an upper surface of the suction nozzle.

13. The suction nozzle of claim 1, wherein the bleed path is in fluid communication with the outlet duct via the suction chamber.

14. The suction nozzle of claim 1, further comprising an agitator inside the suction chamber for agitating the surface to be cleaned through the main suction opening.

15. The suction nozzle of claim 1, further comprising a further fluid path, the further fluid path being in fluid communication with the outlet duct.

16. The suction nozzle of claim 15, wherein the further fluid path is permanently open.

17. A vacuum cleaner comprising the suction nozzle of claim 1.

* * * * *